US006199946B1

(12) United States Patent
Connor, Jr.

(10) Patent No.: US 6,199,946 B1
(45) Date of Patent: Mar. 13, 2001

(54) INFLATABLE BEACH CHAIR

(76) Inventor: Robert L. Connor, Jr., P.O. Box 2156, Mesa, AZ (US) 85214-2156

( * ) Notice: Subject to any disclaimer, the term of this patent is extended or adjusted under 35 U.S.C. 154(b) by 0 days.

(21) Appl. No.: 09/528,589

(22) Filed: Mar. 20, 2000

(51) Int. Cl.[7] ..... A63G 9/10

(52) U.S. Cl. ..... 297/181; 297/188.01; 297/217.1; 297/452.41

(58) Field of Search ..... 297/452.41, DIG. 3, 297/181, 217.1, 188.01; D6/345, 351, 358, 388

(56) References Cited

U.S. PATENT DOCUMENTS

| | | | |
|---|---|---|---|
| D. 158,429 | * | 5/1950 | Adkins . |
| D. 354,174 | * | 1/1995 | Collins et al. . |
| D. 387,410 | | 12/1997 | Peterson . |
| D. 398,694 | | 9/1998 | Boddy . |
| 3,620,570 | | 11/1971 | Wilson . |
| 3,840,916 | * | 10/1974 | Jennings . |
| 4,724,558 | | 2/1988 | Reiff . |
| 5,067,771 | * | 11/1991 | Ellis . |
| 5,290,196 | | 3/1994 | Steel . |
| 5,297,978 | | 3/1994 | Ramset . |
| 5,364,161 | * | 11/1994 | Liu . |
| 5,439,405 | | 8/1995 | Storey et al. . |
| 5,476,404 | | 12/1995 | Price . |
| 5,526,907 | | 6/1996 | Trawick et al. . |
| 5,938,336 | | 8/1999 | King . |

OTHER PUBLICATIONS

Copy of Photograph from Scottsdale Tribune showing hot air balloon flying in Skies Balloonfest of 1991.

* cited by examiner

*Primary Examiner*—Milton Nelson, Jr.
(74) *Attorney, Agent, or Firm*—Frank J. McGue

(57) ABSTRACT

An inflatable beach chair is disclosed having the appearance of a shoe. The inflatable beach chair comprises a seat portion which corresponds to a tongue of the shoe and a beach blanket which is detachably mounted to the seat portion. The chair has two side storage compartments which correspond to eyelets for laces of the shoe. A base corresponds to a sole of a shoe. A cavity has a cover, the cavity corresponding to a foot opening of a shoe while the cavity is adapted to receive a cooler. The beach chair is fabricated of a resilient sheet material thereby being capable of achieving a load supporting state when inflated and being stored in a small volume when deflated. The beach chair includes at least one fill stem and valve combination adapted to inflate or deflate the beach chair as desired.

10 Claims, 2 Drawing Sheets

INFLATABLE BEACH CHAIR

TECHNICAL FIELD

This invention relates to a product for use on a beach, and, more particularly, a product which serves as a beach chair, an advertising medium and a storage device.

BACKGROUND OF THE INVENTION

There is widespread interest in recreational or leisure time visits to beaches. For more comfortable relaxation at the beach, particularly a sandy beach, a beach chair, usually a foldable fight-weight construction, is brought to the beach. Such a chair provides support for a user's back and is more comfortable than lying directly on a beach surface using a beach towel or the like. A beach towel is still useful for drying and cleaning purposes.

In addition to a beach towel and chair, beach goers often bring other items such as coolers, suntan lotion, books, radios to enhance the enjoyment of the beach environment. However, the transportation and carrying such items to a beach can be burdensome and act to diminish the beach experience.

Further, such items as wallets, loose change, car keys and the like are often needed at the beach. However, storage of such items for security purposes is often haphazard at best.

Given the wide popularity of beaches for recreational use, the reach of advertising in that environment would be dramatic.

U.S. Design Pat. No. D387,410 entitled "Inflatable Shoe Boat" which issued on Dec. 9, 1997 to Peterson shows an inflatable shoe boat.

U.S. Design Pat. No. D. 398,694 entitled "Inflatable Chair" which issued on Sept. 22, 1998 to Boddy shows an inflatable chair.

U.S. Pat. No. 4,724,558 entitled "Beach Blanket and Inflatable Chair Combination" which issued on Feb. 16, 1988 to Reiff shows an inflatable chair which is removably attached to the upper surface of a beach blanket.

U.S. Pat. No. 5,526,907 entitled "Beach Carry Bag" which issued on Jun. 18, 1996 to Trawick et al. discloses a beach carry bag including a carrier case having an insulated storage compartment for cooled beverages and a plurality of non-insulated compartments. A lower slot pocket storage compartment is provided for insertion of a flat beach towel which may be inflated to form a head rest or may be fully inflated to form a mattress.

U.S. Pat. No. 5,297,978 entitled "Tote 'N Flote Water Vehicle" which issued on Mar. 29, 1994 to Ramsey discloses a water vehicle comprising an inflatable tube having a rigid seat portion, a dry duffel compartment, and detachable wet and dry stowage compartments. The vehicle may be stored as a lightweight tote.

U.S. Pat. No. 3,620,570 entitled "Chair-Boat Structure" which issued on Nov. 16, 1971 to Wilson et al. shows a floating chair structure which may be in the form of toys or the like. None of the known prior art disclose the device set forth herein.

SUMMARY OF THE INVENTION

It is an object of this invention to provide product useful as both a beach chair and a storage device for a multiplicity of items.

It is an object of this invention to provide a product as previously described which can be controllably inflated to form a beach chair and storage structure.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
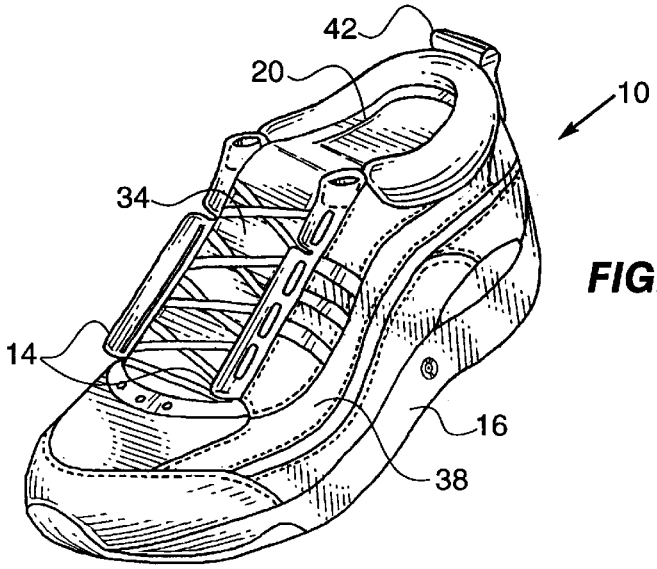
FIG. 1 is a front and side perspective view of the present invention.
Figure 2:
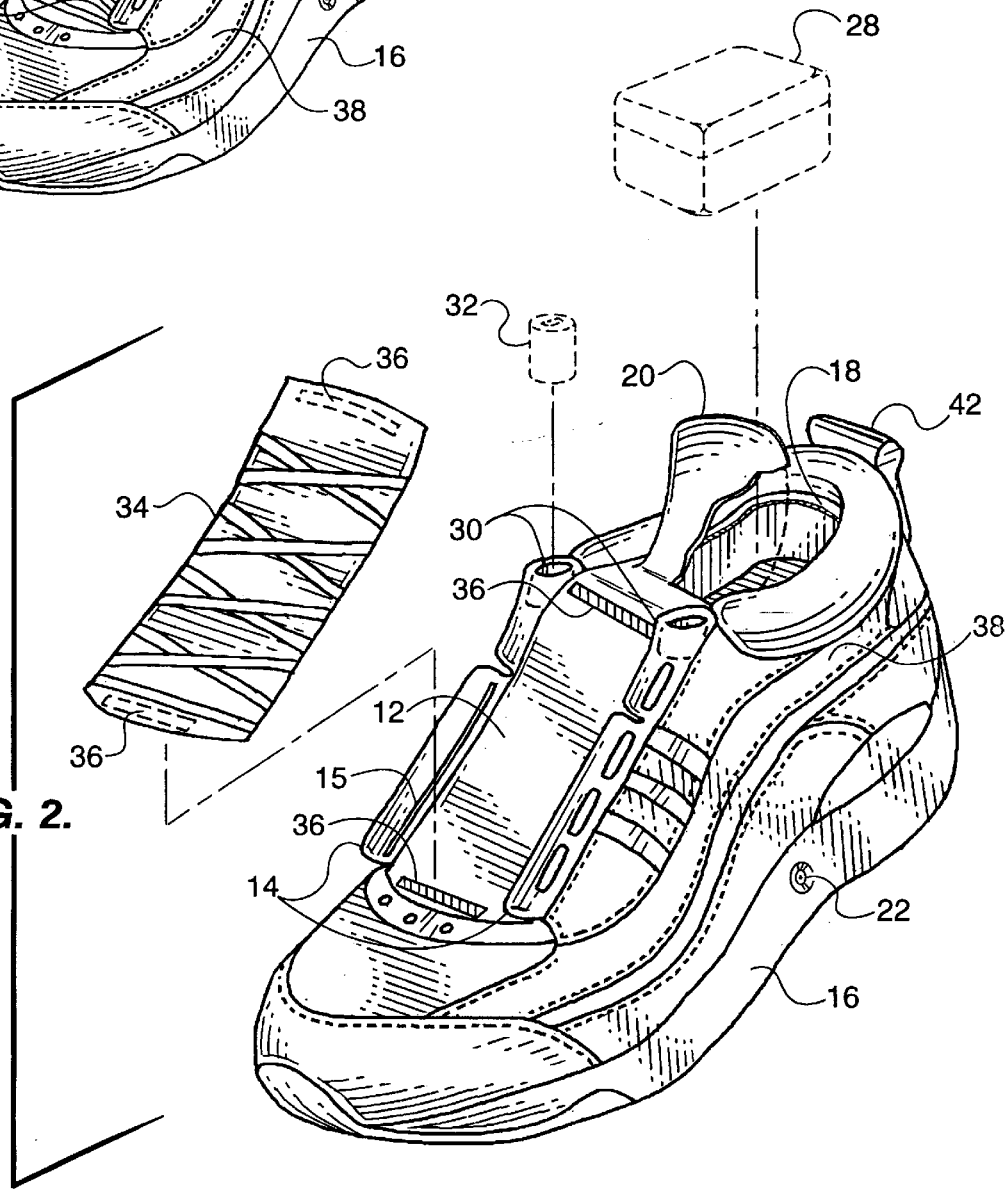
FIG. 2 is a partially exploded perspective view of the present invention.

Referring more particularly to the drawings by characters of reference, FIGS. 1–6 disclose an inflatable beach chair 10 which generally takes on the appearance of a shoe, preferably an athletic shoe though those skilled in the art will recognize that other shoe types are certainly duplicatable in the present invention. For clarity, the various components of chair 10 are described in context of its location on an athletic shoe. The inflatable beach chair 10 is fabricated of a resilient sheet material thereby being capable of achieving a load supporting state when inflated and being stored in a small volume when deflated.

Beach chair 10 comprises a seat portion 12 corresponding to the tongue of the shoe, side storage compartments 14 accessible via openings 15, preferably zippers, corresponding to the eyelets for the laces of the shoe, a base 16 corresponding to the sole of the shoe, and a cavity 18 having a cover 20 corresponding to the foot opening of the shoe.

As shown, cavity 18 is large enough to accommodate a cooler 28 or other more bulky items. Cover 20 in combination with the air inflated chair 10 acts as an extra insulating agent to keep items within cooler 28 cold, or hot, as preferred.

A pair of cup holders 30 adapted to receive a can 32 or the like are provided at the top of storage compartments 14. Again, the air inflated side of each cup holder 30 acts as an insulating agent to keep the liquids within can 32 cold, or hot, as desired.

A beach blanket 34 is detachably mounted to seat portion 12 by, for example, hook and loop fasteners 36, or alternatively, zippers. The user lays directly on blanket 34, if, for example, wet from a dip in the ocean or sweaty from a game of beach volleyball. Alternatively, blanket 34 is detached for drying or cleaning purposes, or if the user simply wishes to recline directly on seat portion 12. To further the illusion of being a shoe, in one embodiment, beach blanket 34 is imprinted with indicia miming the appearance of laces crisscrossing the shoe.

Fill stems and valve combinations 22 are associated with the beach chair 10. The construction of fill stem and valve combination 22 is such as is used on conventional water sports buoyancy which permit the oral inflation thereof In one variant of the invention best seen in FIGS. 4 and 6, a manual air pump 24 is provided. Pump 24 is preferably stored within a zippered compartment 26 positioned on bottom 16.

The exterior surface 38 of chair 10 is available for imprinting with indicia and designs. As one example, exterior surface 38 is imprinted with the stitching and logos of any of the multiplicity of athletic shoe manufacturers. The size and the use on the beach provides an ideal advertising media for such companies who typically market to the outdoor oriented athletic individuals likely to be found on a beach.

Figure 3:
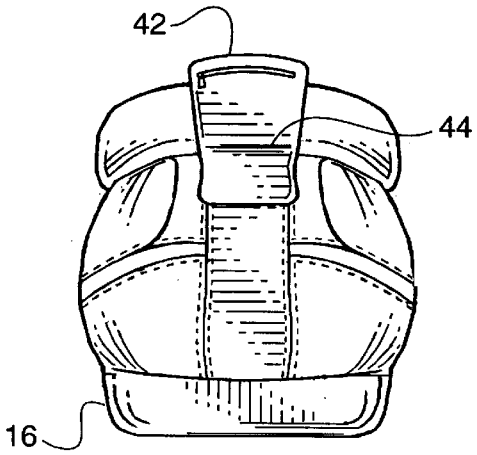
FIG. 3 is a rear view of the present invention.
Figure 4:
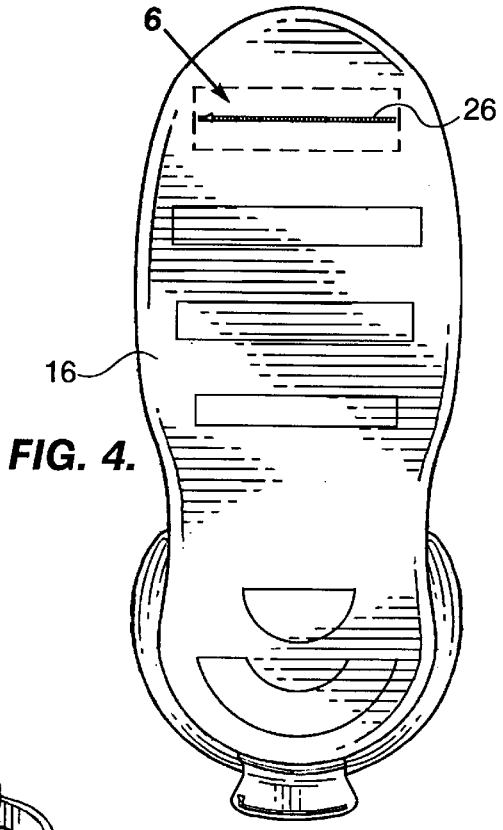
FIG. 4 is a bottom view of the present invention.
Figure 5:
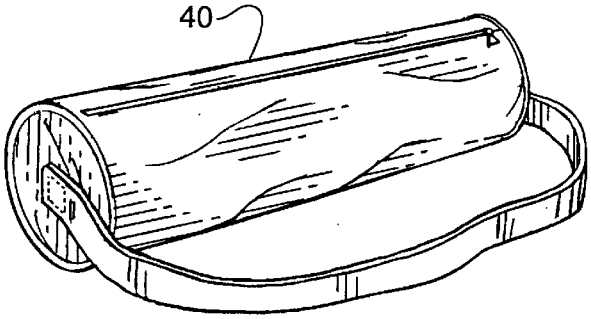
FIG. 5 is a perspective view of one carrying means for the present invention.
Figure 6:
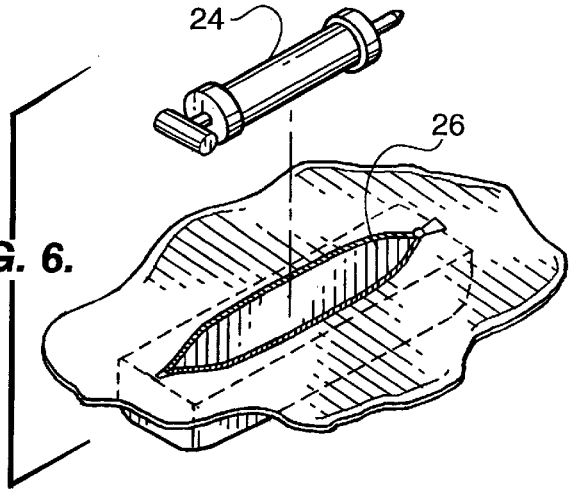
FIG. 6 is a close up view of the area denoted by the numeral 6 in FIG. 4.

For transportation, once deflated chair 10 can be rolled up and packaged within a tote bag 40 shown in FIG. 5. When not in use, tote bag 40 is attached to a strap 42 mounted at the upper heel of chair 10. Alternatively, hook and loop fasteners 44 can be employed to attach empty tote bag 40 as best seen in FIG. 3.

Although only certain embodiments have been illustrated and described, it will be apparent to those skilled in the art that various changes and modifications may be made therein without departing from the spirit of the invention or from the scope of the appended claims.

What is claimed is:

1. An inflatable beach chair having the appearance of a shoe, the inflatable beach chair comprising:

a seat portion corresponding to a tongue of a shoe, a beach blanket being detachably mounted to the seat portion, two side storage compartments corresponding to eyelets for laces of a shoe, a base corresponding to a sole of a shoe, a cavity having a cover corresponding to a foot opening of a shoe, the cavity being adapted to receive a cooler, the inflatable beach chair being fabricated of a resilient sheet material, the beach chair being capable of achieving a load supporting state when inflated and being stored in a small volume when deflated; and at least one fill stem and valve combination adapted to inflate or deflate the beach chair as desired.

2. The inflatable beach chair of claim 1 wherein the shoe is an athletic shoe.

3. The inflatable beach chair of claim 1 further comprising a pair of cup holders adapted to receive a can provided at the top of the side storage compartments.

4. The inflatable beach chair of claim 1 wherein the beach blanket is imprinted with indicia.

5. The inflatable beach chair of claim 1 wherein the exterior surface for said chair is imprinted with indicia.

6. The inflatable beach chair of claim 1 further comprising a zippered compartment positioned on the bottom of the base.

7. The inflatable beach chair of claim 6 further comprising a manual air pump stored within the zippered compartment, the air pump adapted to engage the at least one fill stem and valve combination for inflating the beach chair.

8. The inflatable beach chair of claim 1 further comprising a tote bag adapted to receive the beach chair when deflated.

9. The inflatable beach chair of claim 8 wherein the tote bag is adapted to be attached to the heel of the beach chair when the beach chair is inflated.

10. An inflatable beach chair having the appearance of an athletic shoe, the inflatable beach chair comprising:

a seat portion corresponding to a tongue of an athletic shoe, a beach blanket being detachably mounted to the seat portion, the beach blanket being imprinted with indicia, two side storage compartments corresponding to eyelets for laces of an athletic shoe, a pair of cup holders adapted to receive a can provided at the top of the side storage compartments, an exterior surface of said chair being imprinted with indicia, a base corresponding to a sole of an athletic shoe, a zippered compartment positioned on the bottom of the base, a manual air pump stored within the zippered compartment, the air pump adapted to engage at least one fill stem and valve combination for inflating the beach chair a cavity having a cover corresponding to a foot opening of an athletic shoe, the cavity being adapted to receive a cooler, the inflatable beach chair being fabricated of a resilient sheet material, the beach chair being capable of achieving a load supporting state when inflated and being stored in a small volume when deflated;

a tote bag adapted to receive the beach chair when deflated, the tote bag being adapted to be attached to the heel of the beach chair when the beach chair is inflated, and the at least one fill stem and valve combination adapted to inflate or deflate the beach chair as desired.

* * * * *